US012305474B2

(12) United States Patent
Jarvis et al.

(10) Patent No.: US 12,305,474 B2
(45) Date of Patent: May 20, 2025

(54) WIRELESS CASING PACKER

(71) Applicant: METROL TECHNOLOGY LIMITED, Aberdeen (GB)

(72) Inventors: Leslie Jarvis, Stonehaven (GB); Shaun Ross, Aberdeen (GB); David Martin, Aberdeen (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 0 days.

(21) Appl. No.: 18/286,382

(22) PCT Filed: Apr. 13, 2022

(86) PCT No.: PCT/GB2022/050925
§ 371 (c)(1),
(2) Date: Oct. 11, 2023

(87) PCT Pub. No.: WO2022/219329
PCT Pub. Date: Oct. 20, 2022

(65) Prior Publication Data

US 2024/0191592 A1 Jun. 13, 2024

(30) Foreign Application Priority Data

Apr. 13, 2021 (GB) ..... 2105267

(51) Int. Cl.
*E21B 33/128* (2006.01)
*E21B 23/06* (2006.01)
(Continued)

(52) U.S. Cl.
CPC ..... *E21B 33/128* (2013.01); *E21B 23/06* (2013.01); *E21B 33/1294* (2013.01); *E21B 47/13* (2020.05)

(58) Field of Classification Search
CPC ..... E21B 33/1294
See application file for complete search history.

(56) References Cited

U.S. PATENT DOCUMENTS 2,309,383 A 1/1943 Crites
2,819,762 A 1/1958 Johnston et al.
(Continued)

FOREIGN PATENT DOCUMENTS

GB 1192795 5/1970
WO 2001065067 9/2001
(Continued)

OTHER PUBLICATIONS

Definition of "Casing Packer" (Year: 2024).*
International Search Report and Written Opinion for PCT/GB2022/050925, Jun. 10, 2022.

*Primary Examiner* — Robert E Fuller
(74) *Attorney, Agent, or Firm* — Womble Bond Dickinson (US) LLP

(57) ABSTRACT

A casing packer apparatus (P) comprising a mandrel (2) having a longitudinal throughbore, a packer element (6) mounted on the mandrel, and an expansion mechanism comprising a piston (11, 12) configured to move the packer element from a first position radially outwards to a second position. A bypass conduit (25) extends generally in said longitudinal direction, from one side of an outer sealing face of the packer element to an opposite side of the outer sealing face, and a bypass valve (41) controls said bypass conduit. The bypass valve is controlled by signals received via a wireless receiver (40). The casing packer can be deployed as an integral part of the casing string and used to control pressure build-up in the casing annulus.

32 Claims, 6 Drawing Sheets

(51) Int. Cl.
*E21B 33/129* (2006.01)
*E21B 47/13* (2012.01)

(56) References Cited

U.S. PATENT DOCUMENTS

| | | | | |
|---|---|---|---|---|
| 4,253,521 | A * | 3/1981 | Savage | E21B 23/06 166/123 |
| 4,378,850 | A * | 4/1983 | Barrington | E21B 34/045 166/321 |
| 4,722,400 | A | 2/1988 | Burns | |
| 4,798,243 | A * | 1/1989 | Curington | E21B 17/003 166/134 |
| 5,040,606 | A * | 8/1991 | Hopper | E21B 33/1294 166/321 |
| 6,367,566 | B1 | 4/2002 | Hill | |
| 2003/0042026 | A1 | 3/2003 | Vinegar et al. | |
| 2004/0159447 | A1* | 8/2004 | Bissonnette | E21B 33/1294 166/386 |
| 2005/0028980 | A1 | 2/2005 | Page et al. | |
| 2006/0124295 | A1 | 6/2006 | Maguire | |
| 2008/0023205 | A1 | 1/2008 | Craster et al. | |
| 2009/0084550 | A1 | 4/2009 | Korte et al. | |
| 2009/0223675 | A1* | 9/2009 | Li | E21B 23/06 166/375 |
| 2011/0114333 | A1 | 5/2011 | Fenton | |
| 2012/0298380 | A1 | 11/2012 | Rogers et al. | |
| 2016/0237779 | A1 | 8/2016 | Husby et al. | |
| 2017/0370174 | A1* | 12/2017 | Yun | E21B 33/1208 |

FOREIGN PATENT DOCUMENTS

| | | |
|---|---|---|
| WO | 2004/018833 | 3/2004 |
| WO | 2012010897 | 1/2012 |

* cited by examiner

WIRELESS CASING PACKER

CROSS REFERENCE TO RELATED APPLICATIONS

This application is a 35 U.S.C. 371 National Stage of International Application No. PCT/GB2022/050925, filed Apr. 13, 2022, titled "CASING PACKER," which claims priority to GB Application No. 2105267.5, filed Apr. 13, 2021, titled "CASING PACKER," all of which are incorporated by reference herein in their entirety.

FIELD OF DISCLOSURE

This invention relates to a casing packer, in particular a wirelessly activatable casing packer.

BACKGROUND

A hydrocarbon well commonly has a number of generally nested tubular casing strings which progressively reduce in diameter towards the lower end of the overall borehole. Between adjacent casing strings, a portion of the resulting annulus may be cemented to secure and seal the casing string.

Inside the inner casing, it is common to have packers for a variety of purposes. For example, when testing a well, a packer is deployed to seal tubing in place and direct hydrocarbon fluids from perforations therebelow into the tubing for the duration of the test. The packer is then unseated and removed.

Packers are commonly used inside casing but packers outside of the casing have also been disclosed, such as WO2012/010897 where packers 16 are shown in FIG. 1 in a casing annulus above a cemented-in portion. As detailed on page 23 lines 9-16, these can be activated acoustically in the event of an emergency, in order to inhibit fluid flow.

The pressure in such a casing annulus can vary, for example, because of thermal effects from the production of warm hydrocarbons, or from leaks from the inner casing. This could lead to failure of the casing.

SUMMARY

An object of the present invention is to improve control of a casing annulus and/or mitigate problems with casing annulus control and enhance well integrity and safety.

According to a first aspect of the present invention, there is provided a casing packer apparatus comprising:

- a mandrel having a main longitudinal direction, the mandrel defining a throughbore in the main longitudinal direction;
- a packer element mounted on the mandrel, the packer element comprising an outer sealing face;
- an expansion mechanism comprising a piston configured to move the packer element from a first position, radially outwards to a second position;
- a bypass conduit extending generally in said longitudinal direction, from one side of the outer sealing face to an opposite side of the outer sealing face;
- a bypass valve controlling said bypass conduit;
- a wireless receiver to receive wireless signals to control the bypass valve.

Thus in use the casing packer can be deployed, usually as an integral part of the casing string, in a casing annulus which may be open to the formation to at least mitigate any pressure build-up in the casing annulus. In order to seal the casing annulus from the formation, rather than setting and unsetting the packer element, a bypass conduit and a valve is provided to selectively seal or optionally unseal the casing annulus from the formation.

In use, the first position is a dis-engaged position and the second position an engaged position, that is an outer surface thereof engaged on an outer casing or liner thus in use sealing an annulus between two casing strings.

Normally, the bypass conduit is isolated from a main bore of the mandrel, even when the bypass valve is in an open position. That is, the bypass is not in pressure communication with the bore of the mandrel.

The expansion mechanism may be a compressible expansion mechanism. In particular, it may comprise a member comprising a wedge portion mounted on the mandrel, at least one of the member comprising a wedge portion and packer element being moveable in order for the member comprising a wedge portion to deflect the packer element radially outwards. In preferred embodiments, the packer element is moved longitudinally towards the member comprising a wedge portion.

At least a portion of the bypass conduit may be provided in the member comprising a wedge portion. In alternative embodiments, the bypass conduit may be provided through the mandrel.

The packer apparatus is typically capable of sending signals back. This may relate to confirmation signals, bypass status or data from sensors, such as pressure data, detected at or around the packer apparatus. Thus, the packer apparatus may comprise a wireless transceiver, which comprises the wireless receiver. The packer apparatus may comprise sensors especially at least one pressure sensor. A pressure sensor may be added, or ported to, above and/or below the packer element.

For certain embodiments, the piston is configured to move at least one of the member comprising a wedge portion and the packer element from the first position to the second position.

The piston may be activated by various mechanisms, such as stored pressure or a pyrotechnic device. In certain embodiments, the apparatus may comprise an integral setting mechanism especially a hydrostatic setting mechanism. A hydrostatic setting mechanism includes a low-pressure chamber, a port which in use can be in pressure communication with the well, and a piston driven by well pressure against the action of the low-pressure chamber.

The setting mechanism may include a trigger device, such as a rupture disc or valve, which allows well pressure into a drive chamber through said port and moves the piston against the action of the low-pressure chamber. Movement of piston can then set the packer apparatus i.e. move the packer element radially outwards (and usually packer slips radially outwards), to engage with an outer casing etc. When the trigger device is a valve, it may be wirelessly controlled by EM or acoustic signals or coded pressure pulses.

The piston may be a first piston and a second piston may also be exposed to hydrostatic pressure when setting the packer apparatus, to also, in part, add to the setting force to move from the first to the second position. The first and second pistons are normally connected together. Movement of at least the first piston may open or expose a port to a drive chamber for the second piston. A second low-pressure chamber is normally associated with the second piston.

The trigger device may share said wireless receiver/transceiver as the wireless controller for the bypass valve, or it may have a dedicated wireless receiver/transceiver.

Certain embodiments with wireless activation of the casing packer apparatus do not therefore require a rupture disk on the casing in order to activate, unlike certain known casing packers. Thus a potential leak path through the casing can be avoided, with the first piston. It may resist movement of the member comprising a wedge portion and/or packer element from the second engaged position and so resist return of the set packer from its second position. The lock ring may include a ratchet.

Shear pins may be provided to hold the first piston in place until the piston movement is triggered.

The packer element may be a metal and elastomer structure such as that described in U.S. Pat. No. 5,333,692 (Baugh, 1992) the disclosure of which is incorporate herein by reference in its entirety.

A bypass valve body may be provided comprising the bypass valve. The bypass conduit may extend through the bypass valve body.

The bypass valve is normally adapted to open the bypass conduit. It may be adapted to close the bypass conduit. In preferred embodiments, it can open and close the bypass conduit and preferably consecutively open and/or close the bypass conduit. Thus the bypass valve may be moveable more than once, and may be a multi-cycle valve.

The bypass conduit may include a choke. The valve may comprise the choke. The choke may be adjustable.

Various types of valves may be used. For example, a small piston valve.

Alternatively a plug valve may be used.

Especially if the valve is a single function valve then a sliding sleeve valve may be used.

Thus, the bypass conduit communicates from one side of the outer sealing face to the other, when the bypass valve is open. At least one port may be provided at each end of the bypass conduit. In use, the port(s) are normally in pressure communication with the well.

The at least one port, independently at each end of the bypass conduit, may be a plurality of circumferentially spaced ports.

The packer apparatus may include a screen protecting the ports, such as wire wrap.

The cross-sectional flow area through the bypass valve may be at most 0.5 inches$^2$. However, for single use valves in particular, the flow area may be larger.

The bypass valve and/or the wireless receiver is/are usually secured to the mandrel by way of a clamp, but may be connected by other means.

The member comprising a wedge portion can be threaded to, and usually sealed to, the mandrel.

The mandrel is preferably manufactured from a single piece of material. The mandrel may thus be a single one-piece solid component which defines the internal static body of the setting chambers and provides a mounting for the wedge portion or includes an integral wedge portion. The setting chambers can include the low-pressure chamber and the drive chamber associated with the first and/or optionally also the low-pressure chamber and the drive chamber associated with the second piston.

Such a single piece can eliminate additional leak paths from the bore of the packer apparatus to the annulus e.g. can eliminate thread joints.

The packer element is usually elastomeric, although non-elastomeric seals may also be used. The packer element may be comprised of multiple parts, the different parts may comprise different elastomers. The packer element may comprise non-elastomeric back-up elements, in particular metal back-up elements.

The inner diameter of the mandrel may be at least 5.5 inches (140 mm) or may be at least 8 inches (203 mm).

The packer gauge diameter is the largest fixed outer diameter on the unset packer.

The ratio between the gauge diameter of the packer apparatus in an unset state and the inner diameter of the packer apparatus may be less than 1.6. These diameters are normally the maximum outer diameter and minimum inner diameter respectively. The inner diameter is normally at least 5.5".

This can allow the packer apparatus to be deployed in the tight constraints of a casing annulus. This contrasts with packers provided in a tubing annulus which have a higher ratio.

For certain embodiments, the packer apparatus may have a packer gauge diameter greater than 7.5" and optionally less than 8.6".

For certain embodiments, the packer apparatus may have a packer gauge diameter greater than 9.25" and optionally less than 19".

For certain embodiments, the outer diameter of the packer apparatus in an unset state is greater than 11.0" and less than 15.0", and the minimum inner diameter of the mandrel is at least 8.0".

The packer apparatus may include a threaded portion (usually at each end) for threaded attachment to a casing, and the minimum inner diameter of the packer apparatus is no less than a drift diameter of an API casing with a corresponding size and weight of thread. The suitable API (American Petroleum Institute) standard is being in accordance with 5CT.

The mandrel may have an eccentric shape, that is, the central axis of the inner diameter of the mandrel is different to the central axis of the outer diameter of the mandrel.

This can provide an increased cross-sectional area available for electronics or other components to be provided. This may also provide space, or more space, for porting through the mandrel.

Alternatively, the mandrel has a circular cross-section.

The packer apparatus, in its undeployed state, is usually less than 10 m long, optionally less than 5 m long.

The casing packer apparatus may comprise a valve controller for controlling the valve. It may include the wireless receiver. Optionally it includes a control valve which in turn hydraulically controls the bypass valve. It may also function by stored pressure or a small pyrotechnic.

A filter may be provided to protect valve and/or porting from debris.

The bypass valve may be a metal sealing valve.

The apparatus may also include at least one battery optionally a rechargeable battery and/or microprocessor, such as in the valve controller. Power may alternatively or additionally be provided by an energy harvester such as that disclosed in WO2018122547 incorporated herein by reference in its entirety. The battery may be spaced higher up the well where it's relatively cooler and provides more stable conditions for many batteries. The wireless receiver can be provided with a spaced apart battery or with other components of the casing packer apparatus.

Whilst not especially necessary for casing packer apparatus generally, certain embodiments include packer slips, usually also provided on the mandrel, usually below the packer element.

The wireless signals may be acoustic, electromagnetic, and/or coded pressure pulses or inductively-coupled tubulars which have an integral wire and may be formed tubulars such as casing. At each connection between adjacent lengths there is an inductive coupling. The inductively coupled tubulars that may be used can be provided by N O V under the brand Intellipipe®. Acoustic, electromagnetic and/or coded pressure pules are preferred especially acoustic and/or electromagnetic.

The casing packer apparatus may be adapted to be wirelessly controllable by a wireless signal more than 1 month, more than 1 year or more than 5 years after being run in.

Pressure pulses include methods of communicating from/to within the well/borehole, to/from at least one of a further location within the well/borehole and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic communication device is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

Electromagnetic (EM) (sometimes referred to as Quasi-Static (QS)) wireless communication is normally in the frequency bands of: (selected based on propagation characteristics)

- sub-ELF (extremely low frequency)<3 Hz (normally above 0.01 Hz);
- ELF 3 Hz to 30 Hz;
- SLF (super low frequency) 30 Hz to 300 Hz;
- ULF (ultra-low frequency) 300 Hz to 3 kHz; and
- VLF (very low frequency) 3 kHz to 30 kHz.

These forms of wireless signals are described in greater detail in WO2017/203285 the disclosure of this publication being incorporated herein in its entirety by reference.

In a second aspect, the invention also provides a well comprising casing and a casing packer apparatus as described herein, provided in a casing annulus.

Optional and preferred features of the first aspect of the invention are independently optional and preferred features of the second aspect of the invention and are not repeated here for brevity.

Embodiments may be used to control fluids throughout the annulus including a closed annulus. Preferably however, the casing annulus is an open casing annulus. Thus for such embodiments in accordance with the second aspect of the invention, the packer can be provided in an open annulus, that is with pressure communication to the formation. This at least mitigates the risk of pressure build up in the casing annulus. However, certain disadvantages are associated with an open casing annulus, for example, gas may leak from the formation, or lower down in the well, and build up at the top of the casing annulus.

An advantage of embodiments of the present invention is that an open annulus with the packer apparatus can initially be open, but later be changed to be closed and optionally later opened again, and so on, depending on the balance of advantages/disadvantages of a particular well. Moreover, this choice may be made much later than at the construction of the well and changed depending on well conditions, which may not be apparent at the time of construction of the well.

Normally the packer element in the second position, engages and seals with a further string of casing or liner.

An advantage of certain embodiments is because annulus pressure can be managed using the bypass this allows optimisation of the casing design, which can save capital costs on the well by enabling use of lower specification casing.

A sensor or sensors (especially pressure sensors) is/are normally provided in the casing annulus, especially above the casing packer apparatus. The sensors normally have wireless transmission functionality, either a dedicated transmitter or share a wireless transmitter/transceiver with the casing packer apparatus to which they may be connected physically and/or wirelessly. As well as pressure sensors, temperature sensors or other sensors may also be provided above or below the packer apparatus.

The casing packer apparatus is normally provided relatively deep in the well, such as at least 500 m, 1000 m or at least 1500 m deep in the well. This is measured from the surface of the well, which is defined herein as the top of the uppermost casing. It is normally run in on a casing string.

The well may include a second, or further, optionally open, casing annulus, and a separate casing packer apparatus according to the present invention may be provided therein.

More than one casing packer apparatus can be provided in the same casing annulus, separating it into sections.

The well may be a subsea well. Wireless communications can be particularly useful in subsea wells because running cables in subsea wells is more difficult compared to land wells.

The well may be a deviated or horizontal well, and embodiments of the present invention can be particularly suitable for such wells since they can avoid running wireline, cables or coiled tubing which may be difficult or not possible for such wells.

The well is often an at least partially vertical well. Nevertheless, as noted, it can be a deviated or horizontal well. References such as "above" and below" when applied to deviated or horizontal wells should be construed as their equivalent in wells with some vertical orientation. For example, "above" is closer to the surface of the well through the well.

In a third aspect, the invention also provides a method of using a casing packer apparatus as described herein in a casing annulus in a well.

Optional features of the casing packer described with respect to the first and second aspect of the invention, are independently optional features of the method according to the third aspect of the invention.

The wireless activation for the bypass valve, and/or to set the packer may be received from the surface of the well, for example through the casing. Alternatively or additionally it may be received by way of a short wireless hop from the inner bore of the casing. For example, a signal may be sent from surface on an electric line in the production tubing or the production tubing annulus, or any other inner or outer tubular, then wirelessly from there to the casing packer in the casing annulus. Power may be similarly routed to the packer apparatus, for example through inductive coupling.

The casing packer apparatus is typically run in on a casing string. It may be left in an unset state after being run in, for a period of time, such as at least, a day, at least a week, or at least a month. This may provide the benefit of greater flow bypass during an initial period prior to setting the packer, and then controlling a more limited bypass with the bypass valve after setting.

Wells are presently designed so that casing can cope with high pressures in a casing annulus. For certain embodiments of the present invention, a well may be designed using at least one less highly pressure rated casing strings, since the pressure can be managed in the annulus using the casing packer apparatus.

All references to casing herein include liners unless stated otherwise.

Any reference to receiver or transmitter includes a transceiver.

The sensors/controllers/transceivers/receivers/transmitters may be coupled together physically or wirelessly.

For certain embodiments the wireless controllers and/or valve controllers for control of the bypass valve or setting of the packer apparatus may be provided spaced apart from the packer element and connected to the bypass valve or setting mechanism by hydraulic and or electric control lines.

BRIEF DESCRIPTION OF THE DRAWINGS

Embodiments of the invention will now be described by way of example only with reference to the accompanying drawings in which.

DETAILED DESCRIPTION

Figure 1:
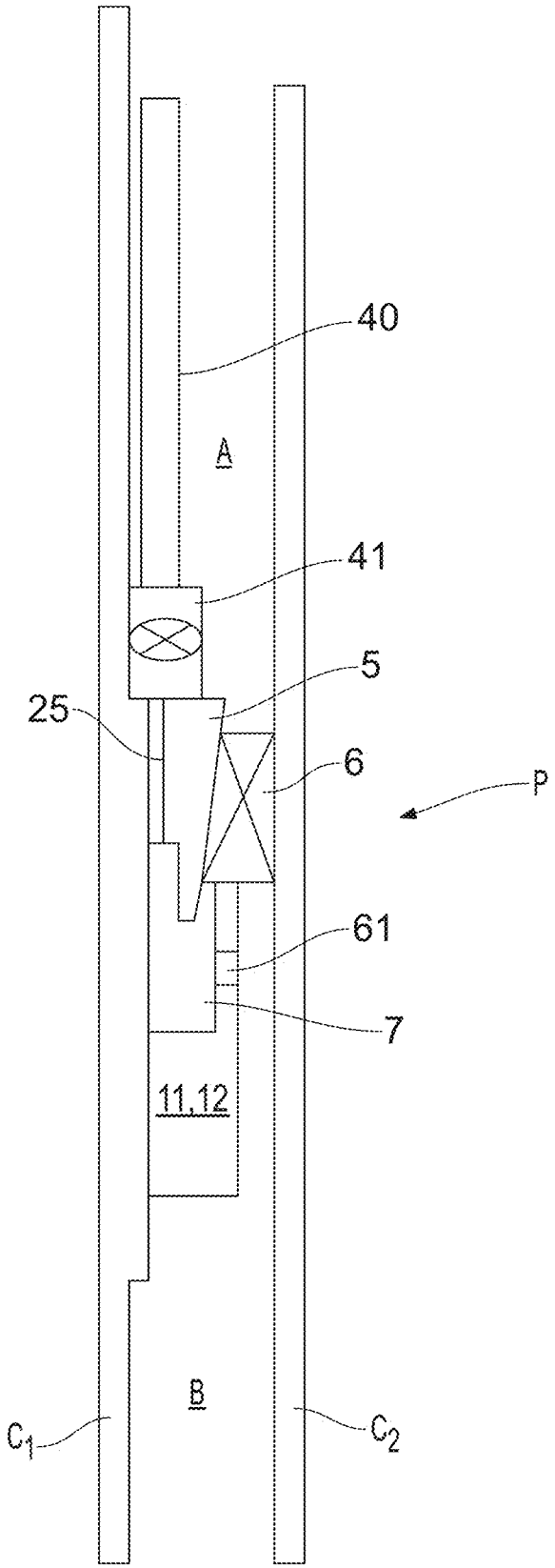
FIG. 1 is a schematic view of an embodiment of a packer apparatus according to the invention deployed within a casing annulus.

The present invention relates to a packer apparatus P for sealing a casing annulus. FIG. 1 schematically shows the packer apparatus P sealing a casing annulus A between an inner casing string C1 and an outer casing string C2. The packer apparatus P is mounted on the inner casing C1 and has an elastomeric seal 6 engaging the outer casing C2 to seal the casing annulus A from the annular section B below, which may be in pressure communication with the formation (not shown) therebelow.

Thus the packer apparatus P can be run into the well on the inner casing C1, optionally left for a period of time, such that the casing annulus A is in pressure communication with the surrounding formation therebelow. Thereafter, the packer apparatus P can be activated so that the seal engages the outer casing C2 and thus seals the casing annulus A so that the annulus above is no longer in pressure communication with the surrounding formation. In this way, any leaks in the inner casing C1 are easier to detect with a closed annulus.

However, in certain circumstances, it may later be beneficial to allow for pressure communication between the casing annulus A and the formation, for example, to allow pressure in the annulus to bleed off to the formation. Rather than unseating the elastomeric seal 6, a fluid bypass 25 is provided across the seal 6, controlled by a valve 41, and wireless valve controller 40. When the control valve 41 is opened, pressurised fluid can pass through a port 61 below the seal 6, through bypass 25 and the valve 41 on the opposite side of the engaged seal 6 (or in the opposite direction).

Thus, the control of fluid flow across or around the packer element 6 is controlled by the operation of the control valve 41. Optionally, the control of fluid flow can be controlled by operation of the control valve 41 in a 'choke' configuration, in which the flow area through the control valve 41 is continuously adjusted to maintain back-pressure on the wellbore. Thus, in such embodiments, the casing annulus A can be selectively and repeatedly changed from being in pressure communication with the formation and being pressure-isolated from the formation, depending on the more important criteria at the particular time.

As will be described in more detail below, in order to set the packer apparatus P to seal the outer casing C2, a setting mechanism comprising a series of pistons 11, 12 and a lock ring 7 interact to direct the elastomeric seal 6 over a packer cone 5 in order to deflect the seal 6 radially outwards and engage and seal against the casing C2.

Figure 2:
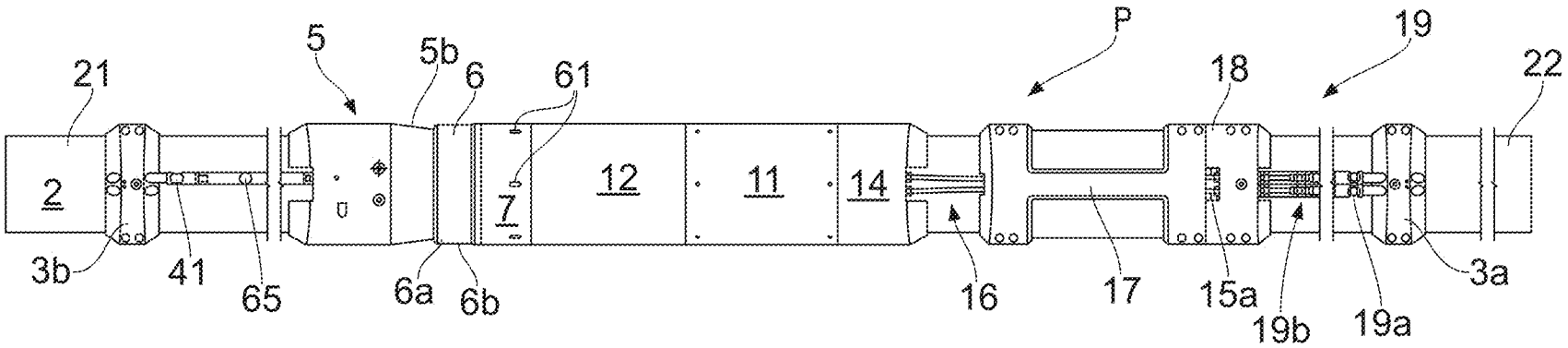
FIG. 2 is a side view of a more detailed embodiment of the packer apparatus according to the invention, in an undeployed state.

Referring now to FIG. 2, there is shown a packer apparatus P in more detail in an undeployed state. The packer apparatus P has a mandrel 2 having a first end 21 and a second end 22. In use the packer apparatus P can be deployed in a well in either direction. For example, the first end 21 may be the upstream "upper" or downstream "lower" end. For ease of reference, the components of the packer apparatus are described using relative terms such as "left" and "right" for the embodiments as illustrated, and are not limiting.

Moving from right to left along the packer apparatus P as shown in FIG. 2, adjacent the second end 22 is a packer controller 19 and lines 19*b* extending from control valves 19*a* to a manifold 18. Smaller lines 16 extend from the manifold 18 (covered by an H-shaped cover 17) to a receiving block 14 next to an annular piston 11.

The control valves 19*a* are operatively connected to a wireless transceiver (not shown) such that they are wirelessly controllable. The control valves 19*a* are fully independent and provide full redundancy in setting the packer and are configured such that, when in an open state, wellbore hydrostatic pressure is allowed to act against the piston 11, via the lines 19*b*, the manifold 18, the lines 16 and the receiving block 14.

Attached to the piston 11 is a second annular piston 12, and attached to it is a lock-ring housing 7, which is also annular in shape. The opposite side of the lock-ring housing 7 abuts the packer element 6 of a packer. The packer includes the packer element 6 and the packer cone 5. The packer element 6 is annular in shape, providing a sleeve, and is preferably formed of an elastomeric portion 6*a* and a metallic portion 6*b*. The packer cone 5 has a wedge portion 5*b*, and is threadably connected to the mandrel 2 and, for this embodiment, is stationary.

A valve 41 and associated wireless valve controller is secured to the mandrel 2 by a clamp 3*b* and controls a port 65, being one end of a bypass across the packer element 6. The other end of the bypass starts with a plurality of circumferentially spaced ports 61 extending through the lock-ring housing 7 into an annular space 62 shown in FIG. 3*a*.

The annular space 62 is defined between the lock-ring housing 7 and an external surface of the mandrel 2. The bypass across the packer element 6 is provided by the annular space 62, a channel 63 between the packer cone 5 and on the outer surface of the mandrel 2, and a channel 64 in the packer cone 5 which leads to the port 65.

Figure 3A:
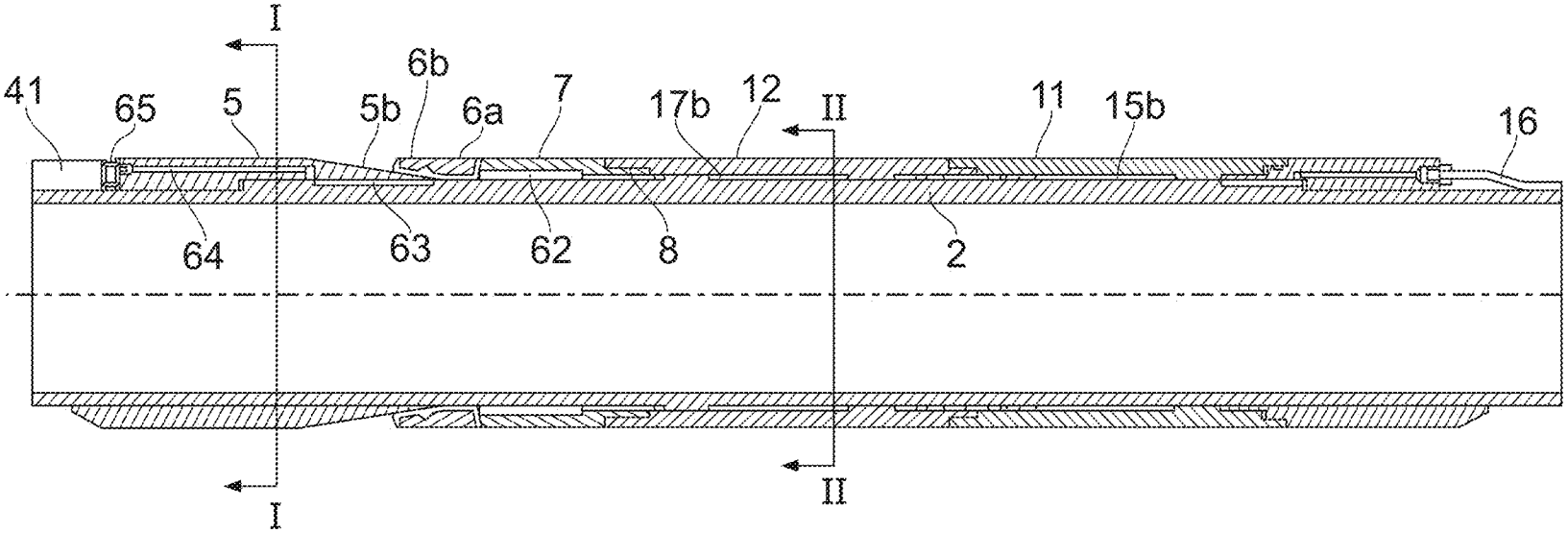
FIG. 3*a* is a cross-sectional view of the packer apparatus of FIG. 2 in an undeployed state.

The outer diameter of the packer apparatus may be measured including the mandrel 2 and the piston 12, such as along the line II-II in FIG. 3*a*. The inner diameter can be measured as the inner diameter (ID) of the mandrel 2. The ratio of OD:ID can be measured and in this embodiment is less than 1.6:1.

Figure 6:
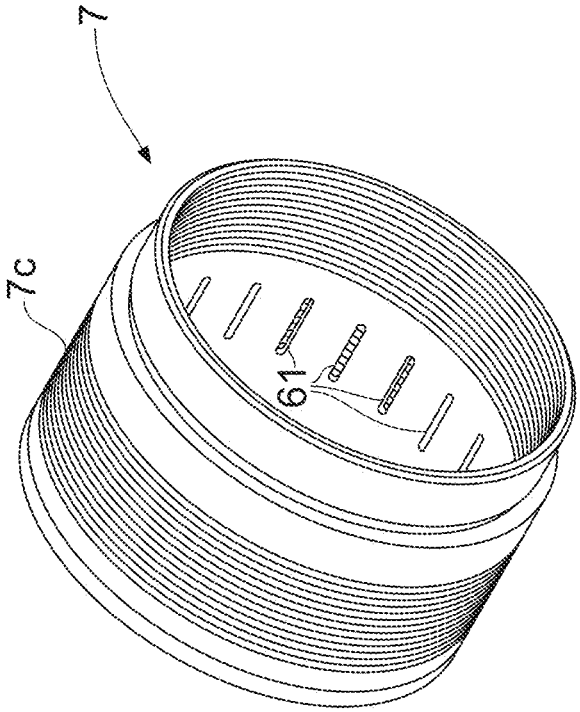

Also shown in FIG. 3*a*, the lock ring housing has a slide lock-ring 8 having a plurality of circumferential teeth configured to engage with a mating profile on the external surface of the mandrel 2 as it is moved therealong, as described below. In FIG. 6 the lock ring housing 7 is illustrated showing the plurality of circumferentially spaced ports 61. These are protected by a filter comprising triangular wire 7*c* wrapped over the top in order to mitigate ingression of dirt or debris into the bypass.

In use, the mandrel 2 of the packer apparatus P is connected to a casing string via coupling member (not shown) at either end providing a threaded, sealed connection between a casing string and the mandrel 2 of the packer apparatus P and run into a wellbore in the undeployed state and set in the well.

Figure 4A:
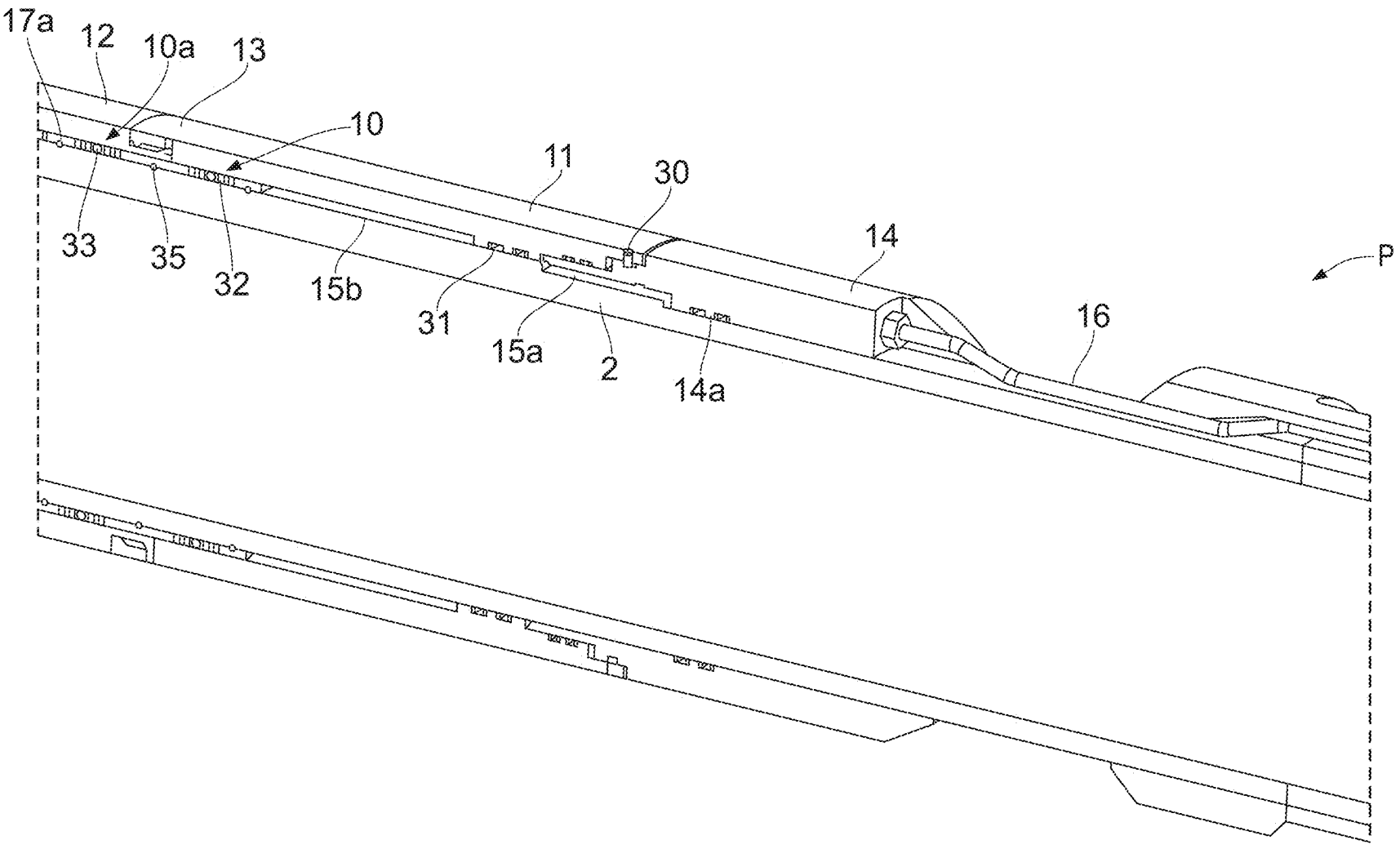
FIG. 4*a* is a sectional perspective view of part of the FIG. 2 packer apparatus in an undeployed state.
Figure 4B:
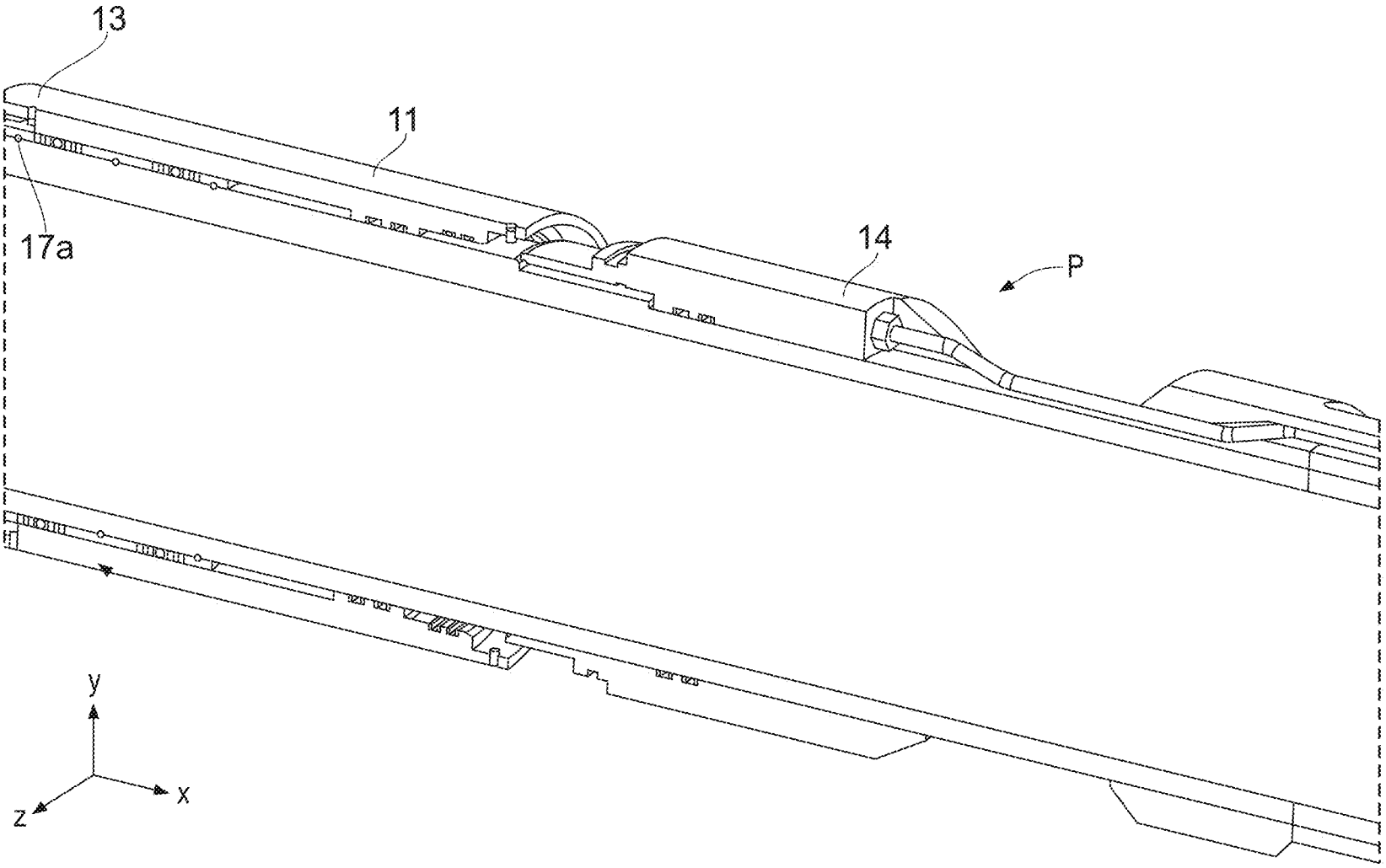
FIG. 4*b* is a sectional perspective view of part of the FIG. 2 packer apparatus in a deployed state.

The operation of the setting mechanism is best illustrated in FIG. 4*a* and FIG. 4*b* which show a perspective view of the packer apparatus P. The connected first and second pistons 11, 12 each have two annular hydrostatic chambers which extend about the external surface of the mandrel 2, respectively termed primary 15*a*, 17*a* and secondary 15*b*, 17*b* (shown in FIG. 3*a*) chambers. The secondary chambers 15*b*, 17*b* have a low pressure compared to the well, such as atmospheric pressure at the surface. By flooding the respective primary annular chambers 15*a*, 17*a* with fluid at well pressure, an axial force is generated, moving the respective pistons 11, 12 and compressing the atmospheric air/gas in the secondary annular chambers 15*b*, 17*b*.

Whilst normally provided as a pair for redundancy, a single line 16 is shown in FIG. 4*a* extending into the stationary receiving block 14 which partly defines the first atmospheric chamber 15*a*. The secondary chamber 15*b* for the first piston 11 is sealed from the first atmospheric chamber 15*a* by seals 31.

A plurality of circumferentially spaced inlet ports 13 extends through the opposite end of the first piston 11 into a holding chamber 35 sealed from the chambers 15*b*, 17*a* by seals 32, 33 respectively.

After deployment, the control valve 19*a* is closed and to set the packer apparatus, a wireless signal is sent to the transceiver (not shown) of the packer controller 19 from the surface, indicating that the control valve 19*a* is to be opened. Hydrostatic pressure thus extends through the lines 19*a*, 19*b*, manifold 18, lines 16 and receiving block 14 to the primary chamber 15*a* of the first piston 11, which creates a pressure imbalance compared to the secondary chamber 15*b*, sufficient to shear the shear pins 30 and drive the first piston 11 towards the left. This trigger then exposes this primary chamber 15*a* to well pressure. Accordingly, the piston 11 moves to the left, as drawn, so that it takes up the position shown in FIG. 4*b*.

The connected second piston 12 is thus moved and the ports 13 align with the primary chamber 17*a* of the second piston 12 thus exposing it to the wellbore hydrostatic pressure which exceeds the pressure in a downstream secondary chamber (not shown) associated with the second piston 12. This additional axial force helps drive the second piston 12 to the left.

As the pistons 11, 12 move along the mandrel they move the connected lock ring housing 7 (shown in FIG. 3*a*) and the connected packer element 6 is forced along and over the wedge portion 5*b* of the packer cone 5 so that it moves radially outward to the deployed position. The travel is so designed that an outer sealing face of the packer element 6 fully engages with the outer casing string before the travel is limited by stops to ensure the seal is fully packed off.

As the lock-ring housing 7 is moved along the mandrel 2, the plurality of circumferential ridges or teeth of the slide lock-ring 8 engage with the external surface of the mandrel 2. This prevents return of the lock-ring housing 7, and retains the packer element 6 in a deployed state even in the event of the system being depressurised.

Figure 5:
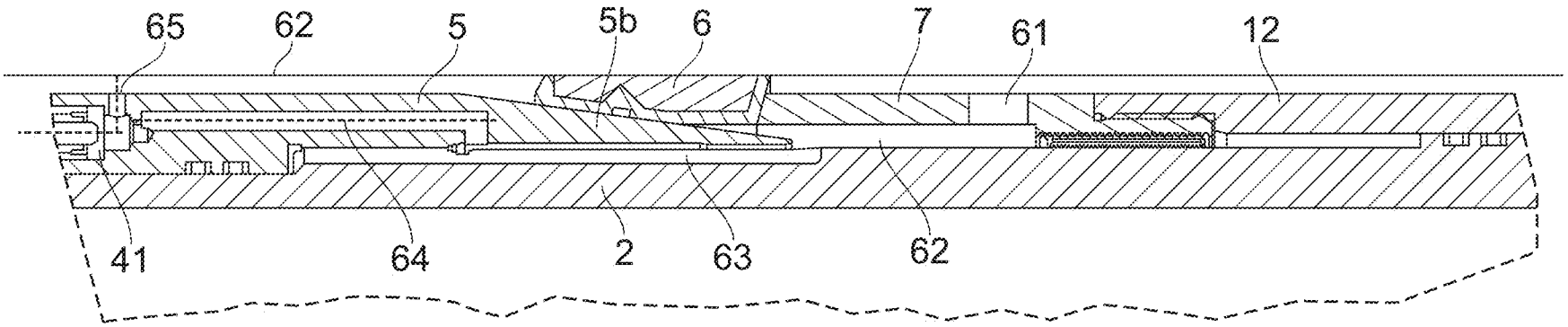
FIG. 5 is a side cross-sectional view of the packer apparatus in a deployed state against an outer casing; and, FIG. 6 is a lock-ring housing for use with embodiments of the packer apparatus of the present invention.

FIG. 5 shows a deployed state where the packer element 6 is displaced radially outwards by the wedge portion 6*b* of the packer cone 5 so that an outer sealing face thereof is against a casing C2. The bypass across the packer element extends from the ports 61, through the annular space 62, the channel 63 between the packer cone 5 and on the outer surface of the mandrel 2, and the channel 64 in the packer cone 5 which leads to the port 65 controlled by the wireless valve 41.

With the packer apparatus P in the deployed state, fluid flow across or around the packer element 6 can thus be wirelessly controlled.

Figure 3C:
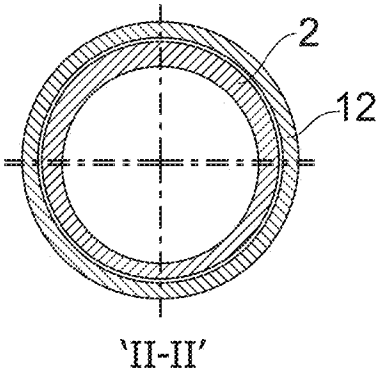
FIG. 3*c* is a cross-sectional view along line II-II of FIG. 3*a;*
Figure 3B:
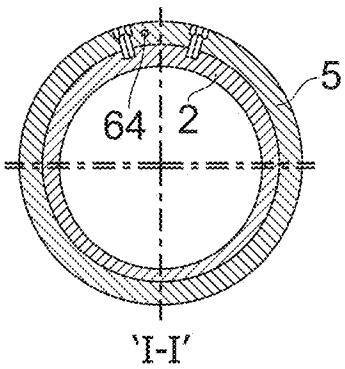
FIG. 3*b* is a cross-sectional view along line I-I of FIG. 3*a;*

The illustrated embodiments include eccentric components which allow for efficient packing of the different components. FIGS. 3*b* and 3*c* show sections through the FIG. 3*a* packer apparatus. As noted, the inner diameter of the mandrel 2 is thicker at the top (in the orientation illustrated) compared to the bottom. Therefore the centre-point of the inner diameter of the mandrel is slightly below the centre point of the outer diameter of the mandrel (which is coincident with the centre point of the ID and OD of the outer component, the packer cone 5 in FIG. 3*b* and the second piston 12 in FIG. 3*c*). For the present embodiment, the retaining block 14, packer cone 5 and mandrel 2 are eccentric in this way.

Improvements and modifications may be made without departing from the scope of the invention. For example, in alternative embodiments a different setting mechanism may be used. For example, a rupture mechanism may be provided to the inner diameter of the inner casing, in order to provide the driving force necessary to set the packer element.

The invention claimed is:

1. A casing packer apparatus comprising:

a mandrel having a main longitudinal direction, the mandrel defining a throughbore in the main longitudinal direction;

a packer element mounted on the mandrel, the packer element comprising an outer sealing face;

a hydrostatic setting mechanism comprising a lock ring in a lock ring housing, a low-pressure chamber, an external port, and a piston being configured to be driven by well pressure against the action of the low-pressure chamber, the hydrostatic setting mechanism configured to move the packer element from a first position, radially outwards to a second position, and the lock ring configured to move with the piston and to resist return of the packer element from the second position;

a bypass conduit extending generally in said longitudinal direction, from one side of the outer sealing face to an opposite side of the outer sealing face;

a bypass valve controlling said bypass conduit; and a wireless receiver to receive wireless signals to control the bypass valve.

2. The apparatus claimed in claim 1, wherein the bypass valve is moveable more than once.

3. The apparatus as claimed claim 2, wherein the bypass valve is a multi-cycle valve.

4. The apparatus as claimed in claim 1, wherein the bypass valve is a piston valve.

5. The apparatus as claimed in claim 1, wherein the flow area through the bypass valve is at most 0.5 square inches.

6. The apparatus as claimed in claim 1, wherein the bypass valve is operable to open in a choke configuration.

7. The apparatus as claimed in claim 1, wherein the bypass conduit incorporates a filter with maximum openings smaller than the smallest restriction in the bypass conduit and the bypass valve.

8. The apparatus as claimed in claim 1, wherein the ratio between a gauge diameter of the packer apparatus in the first position and an inner diameter of the packer apparatus in the first position is less than 1.6.

9. The apparatus as claimed in claim 1, further comprising a threaded portion for threaded attachment to a casing, and wherein the minimum inner diameter of the packer is no less than a drift diameter of an API casing with a corresponding size and weight of thread.

10. The apparatus as claimed in claim 1, having a packer gauge diameter greater than 7.5 inches and optionally less than 8.6 inches.

11. The apparatus as claimed in claim 1, having a packer gauge diameter greater than 9.25 inches and optionally less than 19 inches.

12. The apparatus as claimed in claim 1, wherein the inner diameter of the mandrel is at least 5.5 inches.

13. The apparatus as claimed in claim 1, wherein the outer diameter of the packer apparatus in an unset state is greater than 11.0 inches and less than 15.0 inches, and wherein the minimum inner diameter of the mandrel is at least 8.0 inches.

14. The apparatus as claimed in claim 1, wherein the hydrostatic setting mechanism includes a member comprising a wedge portion mounted on the mandrel, and wherein the member comprising the wedge portion and the packer element is moveable so that the wedge portion delfects the packer element radially outwards.

15. The apparatus as claimed in claim 14, wherein the packer element is moveable towards the member comprising the wedge portion.

16. The apparatus as claimed in claim 14, wherein at least a portion of the bypass conduit is provided in the member comprising the wedge portion.

17. The apparatus as claimed in claim 14, wherein the piston is configured to move at least one of the member comprising the wedge portion and the packer element from the first position to the second position.

18. The apparatus as claimed in claim 1, wherein the hydrostatic setting mechanism has a member comprising a wedge portion which is fixed to, and sealed to, the mandrel.

19. The apparatus as claimed in claim 1, further comprising a one-piece mandrel defining an internal static body of the low-pressure chamber and providing (a) a mounting for a wedge portion or (b) including an integral wedge portion of the hydrostatic setting mechanism.

20. The apparatus as claimed claim 1, wherein the hydrostatic setting mechanism includes a trigger device which can allow well pressure through the port into a drive chamber to move the at least one piston.

21. The apparatus as claimed in claim 20, wherein the trigger device comprises a wirelessly controlled valve.

22. The apparatus as claimed in claim 1, wherein the hydrostatic setting mechanism comprises a second piston with associated drive chamber, external port to the drive chamber, and low-pressure chamber and wherein the second piston is configured to be driven, at least in part, by well pressure in the associated drive chamber against the action of the associated low-pressure chamber.

23. The apparatus as claimed in claim 1, comprising at least one of a wireless transmitter and a wireless transceiver which comprises the wireless receiver.

24. The apparatus as claimed in claim 1, wherein the mandrel has an eccentric shape, that is, the central axis of the inner diameter of the mandrel is different to the central axis of the outer diameter of the mandrel.

25. The apparatus as claimed in claim 1, wherein the wireless signals include acoustic and/or electromagnetic signals.

26. The apparatus as claimed in claim 1 comprising at least one battery, and/or a microprocessor.

27. A well comprising casing and a casing packer apparatus as claimed in claim 1, provided in a casing annulus.

28. The well as claimed in claim 27, wherein the casing annulus is an open casing annulus.

29. The well as claimed in claim 27, wherein the casing annulus comprises a pressure sensor above the casing packer apparatus, the pressure sensor including a wireless transmitter.

30. A method of operating the well as claimed in claim 27, comprising moving the bypass valve from one of an open or closed position to the other of the open or closed position in order to open or close communication between a portion of the casing annulus above the packer apparatus and a formation.

31. A casing packer apparatus comprising:

a mandrel having a main longitudinal direction, the mandrel defining a throughbore in the main longitudinal direction;

a packer element mounted on the mandrel, the packer element comprising an outer sealing face;

a hydrostatic setting mechanism comprising a low-pressure chamber, an external port, and a piston being configured to be driven by well pressure against the action of the low-pressure chamber, the hydrostatic setting mechanism configured to move the packer element from a first position, radially outwards to a second position;

a one-piece mandrel defining an internal static body of the low-pressure chamber and (a) providing a mounting for a wedge portion, or (b) including an integral wedge portion;

a bypass conduit extending generally in said longitudinal direction, from one side of the outer sealing face to an opposite side of the outer sealing face;

a bypass valve controlling said bypass conduit; and a wireless receiver to receive wireless signals to control the bypass valve.

32. A casing packer apparatus comprising:

a mandrel having a main longitudinal direction, the mandrel defining a throughbore in the main longitudinal direction;

a packer element mounted on the mandrel, the packer element comprising an outer sealing face;

a hydrostatic setting mechanism comprising a first low-pressure chamber, a first external port, a first piston being configured to be driven by well pressure against the action of the first low-pressure chamber, a second low-pressure chamber, a drive chamber, a second external port associated with the drive chamber, and second piston configured to be driven, at least in part, by well pressure in the drive chamber against the action of the second low-pressure chamber, the hydrostatic setting mechanism configured to move the packer element from a first position, radially outwards to a second position;

a bypass conduit extending generally in said longitudinal direction, from one side of the outer sealing face to an opposite side of the outer sealing face;

a bypass valve controlling said bypass conduit; and a wireless receiver to receive wireless signals to control the bypass valve.

* * * * *